US010368176B2

(12) United States Patent
Karamuk et al.

(10) Patent No.: US 10,368,176 B2
(45) Date of Patent: Jul. 30, 2019

(54) EARPIECE FOR COUPLING A HEARING AID TO A USERS'S EAR CANAL AND A METHOD FOR MANUFACTURING SUCH AN EARPIECE

(71) Applicant: Sonova AG, Staefa (CH)

(72) Inventors: Erdal Karamuk, Maennedorf (CH); Hans Georg Meier, Uerikon (CH); Markus Mueller, Maennedorf (CH)

(73) Assignee: Sonova AG, Stäfa (CH)

( * ) Notice: Subject to any disclaimer, the term of this patent is extended or adjusted under 35 U.S.C. 154(b) by 0 days.

(21) Appl. No.: 15/769,077

(22) PCT Filed: Nov. 10, 2015

(86) PCT No.: PCT/EP2015/076152
§ 371 (c)(1),
(2) Date: Apr. 18, 2018

(87) PCT Pub. No.: WO2017/080585
PCT Pub. Date: May 18, 2017

(65) Prior Publication Data

US 2018/0317031 A1 Nov. 1, 2018

(51) Int. Cl.
*H04R 25/00* (2006.01)

(52) U.S. Cl.
CPC ..... *H04R 25/652* (2013.01); *H04R 25/456* (2013.01); *H04R 2460/09* (2013.01); *H04R 2460/11* (2013.01)

(58) Field of Classification Search
CPC . H04R 2460/09; H04R 25/652; H04R 25/654
See application file for complete search history.

(56) References Cited

U.S. PATENT DOCUMENTS

2006/0215862 A1* 9/2006 Huynh ..... H04R 25/654 381/324
2009/0028356 A1* 1/2009 Ambrose ..... H04R 1/1016 381/71.6
2012/0281865 A1* 11/2012 Caldarola ..... H04R 5/02 381/328

FOREIGN PATENT DOCUMENTS

WO 2009015210 A2 1/2009
WO 2015/13194 A1 9/2015

OTHER PUBLICATIONS

International Search Report and Written Opinion; International Application No. PCT/EP2015/076152, Applicant: Sonova AG; filed Nov. 10, 2015, dated Jul. 8, 2016, 13 pages.

* cited by examiner

*Primary Examiner* — Sunita Joshi

(57) ABSTRACT

This invention relates to an earpiece (1) for coupling a hearing aid (10) to the ear (20) of a hearing aid user, comprising a seal (2) conforming to the shape of the user's ear canal (30) and therein retained; wherein the seal (2) comprises a sound output bore (3) connected to a receiver (11) of the hearing aid (10); and a multiplicity of through openings (4) spaced around the sound output bore (3). The number of the openings (4) is comprised in a range of 50 to 2000; and the openings (4) have diameters in the range of 50 to 250 micrometers. The present invention also relates to a method of manufacturing such an earpiece (1).

15 Claims, 4 Drawing Sheets

EARPIECE FOR COUPLING A HEARING AID TO A USERS'S EAR CANAL AND A METHOD FOR MANUFACTURING SUCH AN EARPIECE

The present invention relates to an earpiece for coupling a hearing aid to the ear of a hearing aid user, comprising a seal conforming to the shape of the user's ear canal and therein retained; and particularly to an earpiece provided with a seal comprising a multiplicity of specially designed through openings spaced around a sound output bore. The present invention also relates to a method of manufacturing such an earpiece.

The term hearing aid shall be understood as a device to be worn at the vicinity or directly within the ear of a person to improve the individual hearing capacity of this person. Such an improvement may include the prevention of the receiving of certain acoustic signals in terms of ear protection.

In relation to their application and user indication, and according to the corresponding main solutions available on the market, such hearing devices can be worn, for instance, behind the ear (BTE), within the ear (ITE) or completely within the ear (CIC). The latest design developments have made available hearing devices that are even smaller than completely within the ear (CIC) devices, aptly named invisible in the canal (TIC) hearing aids.

Hearing aids normally comprise at least one microphone as electroacoustic input transducer; at least one speaker—usually called receiver—as electroacoustic output transducer; and an electronic signal processing circuitry, connected with said microphone and said speaker, for the processing and manipulation of electronic signals. This electronic signal processing circuitry may comprise analogue or digital signal processing devices. Said elements are usually arranged within at least one main case or shell of the hearing device. The electronic signal processing circuit performs various signal processing functions. Such signal processing functions can include amplification, background noise reduction, tone control, etc.

The signal processing functions of current hearing aids can be provided with the option of adjustable operational modes or parameters or characteristics, thus allowing user customization of the hearing aids or their prompt adaptive response to given, changeable environment conditions.

It will be recognized that the features of the present invention are substantially compatible with any style of hearing aid comprising an earpiece for coupling the hearing aid to the ear of a hearing aid user, and in particular an earpiece comprising at least a seal conforming to the shape of the user's ear canal and therein retainable in place, for instance by exertion of compressive forces on the ear canal.

The features of the present invention are therefore substantially compatible with all of the abovementioned hearing aid models. The present invention can be incorporated, for instance, in behind the ear (BTE) hearing device models, particularly the ones traditionally using a thin tubing having at an end thereof a non-custom dome-shaped earpiece element, also designatable as dome, to deliver the sound from the hearing aid to the patient's ear. Such a dome-shaped earpiece element can be, for instance, friction-fitted or clicked onto the abovementioned thin tubing.

The present invention can also be incorporated in especially modified behind the ear (BTE) hearing device models, designatable as a receiver-in-the-canal (RIC) hearing aids, wherein the receiver is designed to be placed in the ear canal of a user to directly deliver sound into such ear canal. In such RIC hearing aids, seals such as domes are typically fit directly onto receivers.

The present invention can also be applied to within the ear (ITE), completely within the ear (CIC) or invisible in the canal (IIC) hearing aids, wherein a non custom-made—or alternatively even a custom-made—seal apparatus of a hearing aid earpiece surrounds an acoustic assembly core comprising a receiver in the user's ear canal.

In fact, for virtually all hearing aid configurations wherein the sound needs to be delivered from a receiver to a tympanic membrane through a user's ear canal, a sound output bore connected to the receiver is typically incorporated in a seal of an earpiece. Such seals can take the form of standard dome-shaped elements or even of custom-made earmold components.

Earpieces are known, comprising domes or earmoulds, that are designed to fit in a hearing aid user's ear and to couple a hearing aid to the user's ear canal. Generally, in such earpieces, the sound is delivered to the tympanic membrane both via said sound output bores coupled to a receiver and via so-called vents which take the form of open channels putting the ear canal in connection with the air outside the ear canal. Normally, the sound passing through the sound output bores is amplified sound, whereas the sound passing though the vents is direct, unamplified sound.

Such earpieces are oftentimes instant-fit and standardized. As above explained, they can however also be custom-made and take the form of individual earmoulds.

With reference to standard, pre-sized earpieces, they usually are dome-shaped elements, generally moulded out of pliable silicone rubber and made available in different sizes in order to fit various ear canal sizes and partially acoustically seal the ear canal off from the surrounding environment.

Traditional earpieces can be provided with a limited array of acoustic characteristics which take into account different hearing losses.

The provision of a limited number of vents, in the form of holes, in the earpieces according to the current practice, is in fact an attempt at providing some aeration to the ear canal and at preventing the formation of a vacuum that would complicate a hearing aid removal; it also aims at helping somehow achieve a modification of the acoustics of the amplified sound within the ear canal. Venting, for instance, can affect the perception by the hearing aid user of his own voice.

The provision of a limited number of vents in the form of holes in the earpieces is also synthetically designated by audiology experts as "open fitting". Open fitting reflects the intention to find a compromise between different instances.

On the one hand, several positive effects of open fitting are known which improve, to a given extent, the auditory experience of hearing aid wearers. It is, in fact, desirable to mitigate an occlusion effect brought about by the closure of the ear canal by an earpiece as above introduced, thus avoiding the perception of an unnatural, boomy-sounding own voice or unbearably loud crunching when chewing. It is also advantageous to let in the ear canal unamplified ambient low frequency sounds: in this respect, the provision of vents enhances the perception by a user of such low frequency sounds from the outside environment, so that important cues for sound localization are preserved and a natural sound quality is guaranteed. In addition to that, open fitting can also enable to achieve an adjustment of the real-ear gain in the region of unaided ear canal resonance, that is open fitting can be employed for strategically damping the real-ear sound amplification.

On the other hand, though, excessive open fitting by provision of vents may give rise to several correlated problems. Excessive venting can, for instance, result in adverse feedback to the microphone unit. Moreover, vent-induced leakage can cause undesirable loss in output sound pressure levels in the low-frequency gain area. The hearing performance can be lowered in loud environments, as the sound cleaning functions incorporated in the hearing aids' processing units—such as noise cancelling and/or directionality—become less effective.

A limited, generally single-digit number of relatively large vents in the form of openings or holes in a conventional earpiece seal, such as a dome-shaped, silicon molded seal is not suitable to achieve an effective, fine adjustment of acoustic parameters linked to earpieces designed for introduction in the user's ear canal. A balance between a reduction of the occlusion effect; a reduction of an adverse feedback to the microphone unit of the hearing aid through the vents and a possible compensation of the vent leakage inducing a gain decrease at the lower hearing frequencies cannot be effectively obtained by the domes or earmolds currently in use.

Especially, though not exclusively, for those applications wherein an instant-fit earpiece is needed that acoustically couples a hearing aid to a given user's ear canal, the domes presently on the market are not designed to precisely tailor a desired leakage level; a predetermined occlusion effect and, concurrently, the extent to which unamplified sounds from the outside should reach the eardrum or to which the natural ear canal resonance should be damped.

In addition to that, the design of state of the art domes or earmolds does not allow to balance an effective acoustic coupling to the user's ear, as above pointed out, with the exigency that the domes or earmolds keep a shape suitable to hold in the user's ear canal. The design and patterns adopted for the vents in current earpieces are such that the vent leakage reachable has a structural upper limit in that even a limited number of such larger openings would otherwise result in excessive deformation and, ultimately, in a loss of coupling, both physical and acoustical, of the domes or earmolds with the ear canals.

US 2010/166241 A1 discloses an ear tip at the end of a tube coupling a hearing aid receiver to the ear canal of hearing aid user. The ear tip comprises:

an ear tip inner dome, having a plurality of spaced openings therearound; and an ear tip outer dome, having a hearing aid sound output bore and also a plurality of openings spaced therearound, wherein the outer dome is rotatably mounted over the inner dome so that the extent to which the openings in inner and in the outer dome overlap can be varied.

The venting adjustment system proposed by US 2010/166241 A1 is affected by several drawbacks. In fact, the manipulation of the double dome through relative rotation by the desired degree is complicated to attain. Moreover, the manufacturability of such ear tip is arduous, also on account of the movements that the two miniature domes need to execute. In the face of a tricky usability, still the ear tip of 2010/166241 A1 fails to attain a fine adjustment of the acoustic parameters by variation of venting areas as proposed, especially on account of the provision of a limited number of still relatively large vents. The extension of each of the holes in the dome necessarily entails a weakening of the dome structure and a reduced capacity of the ear tip to be retained in place in the ear canal by exerting a compression on the canal's walls.

Thus, there exists a need for an earpiece for coupling a hearing aid to the ear of a hearing aid user which is designed in a way that:

- a high degree of fine-tuning is achieved in performing adjustment of the acoustic parameters by venting;
- a high precision is attained in tailoring the acoustic coupling of a hearing aid to the specific ear canal of an individual user and to predetermined, targeted settings;
- a high consistency and reliability is obtained in providing an earpiece with accurate venting characteristics, according to a reproducible method;
- an ideal balancing is enabled between:
  - a compensation of an occlusion effect and a damping of an ear canal resonance; and
  - a compensation of a reduction in the acoustic gain in the lower region of the hearing frequencies due to vent leakage There also exists a need for a related method of manufacturing an earpiece for coupling a hearing aid to the ear of a hearing aid user which can perform in a way that the above needs are satisfied.

Accordingly, a major objective of the present invention is to provide an ameliorated design for an earpiece for coupling a hearing aid to the ear of a hearing aid user, by a seal conforming to the shape of the user's ear canal and therein retained. Such an ameliorated design is meant to support an easier and more efficient tailoring of acoustic characteristics in connection with earpiece venting.

Another objective of the present invention is to improve the ability of modulating the acoustic resistance offered by vents incorporated in the seal of earpieces and to modify, in function of the vent design and arrangement, the overall acoustic response of earpieces.

Yet another objective of the present invention is to provide an earpiece whose deformation behaviour is not adversely affected by the provision of vents.

These problems are solved through an earpiece, and a correlated method of manufacturing such an earpiece, according to the main claims. Dependent claims further introduce particularly advantageous embodiments for such a device and related method.

The inventive solution basically requires designing an earpiece for coupling a hearing aid to the ear of a hearing aid user, comprising a seal conforming to the shape of the user's ear canal and therein retained, wherein said seal incorporates a high density of miniaturized through openings, according to an approach and an arrangement different from those followed in the prior art.

In fact, the design of an earpiece according to the present invention advantageously enables to precisely aim at incorporating a defined acoustic leakage level, by providing specially designed openings or vents in a seal of such earpiece. The new approach of the present invention allows to purposely integrate more accurate and reliably reproducible venting characteristics in the seal of an earpiece, thereby making it possible to tailor the acoustic features of a so-called open fitting of a hearing device when coupled to a given ear canal.

The earpiece design concept according to the present invention also offers the advantage of better decoupling:

- the mechanical retention features of an earpiece seal, which needs to conform to and seal against the walls of the user's ear canal, also under deformation; and the acoustic features of such earpiece seal, correlated to venting and vent leakage, so that a fine-tuning of the latter does not adversely affect the former.

Other objectives, features and advantages of the present invention will be now described in greater detail with reference to specific embodiments represented in the attached drawings, wherein.

Figure 1:
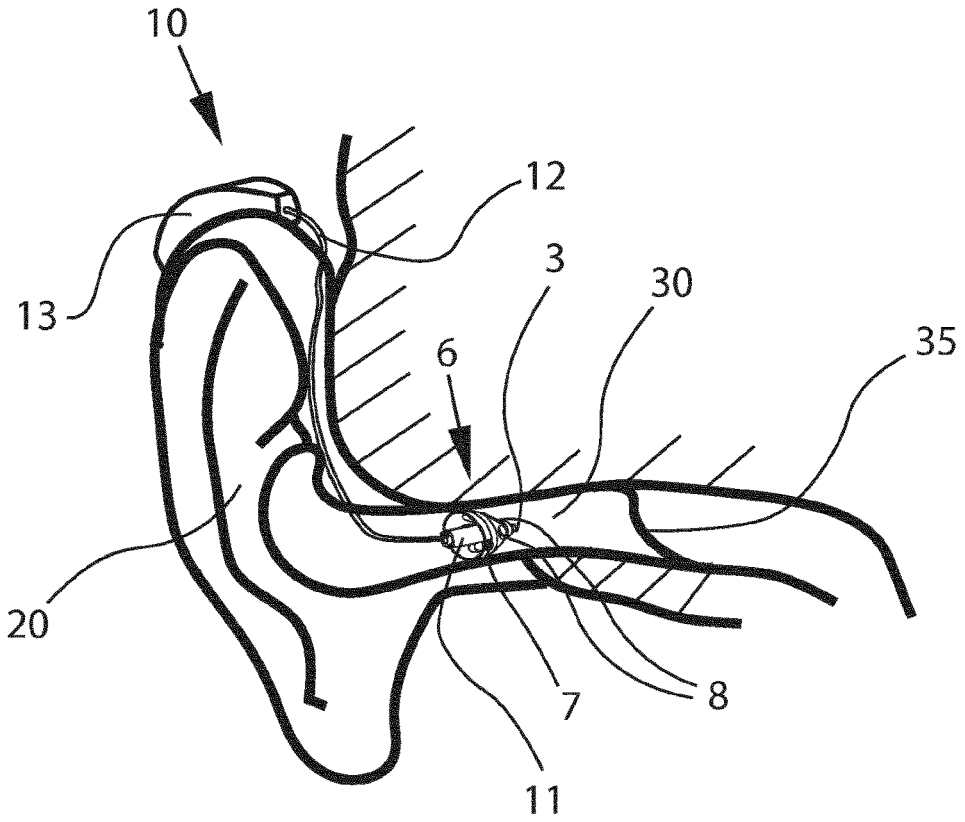
FIG. 1 is a schematic representation of a hearing aid comprising a conventional earpiece for coupling the hearing aid to the ear of a hearing aid user, the earpiece comprising a typical seal integrating a limited, single-digit number of openings, when inserted in an ear canal.
Figure 1A:
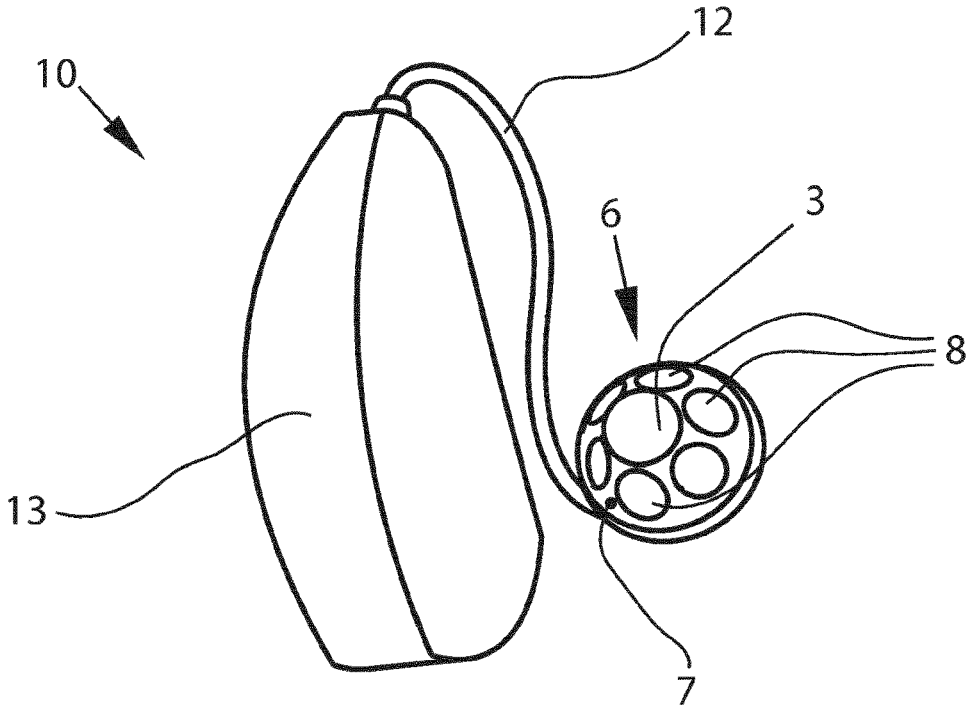
FIG. 1A is a perspective view of the hearing aid of FIG. 1.
Figure 5:
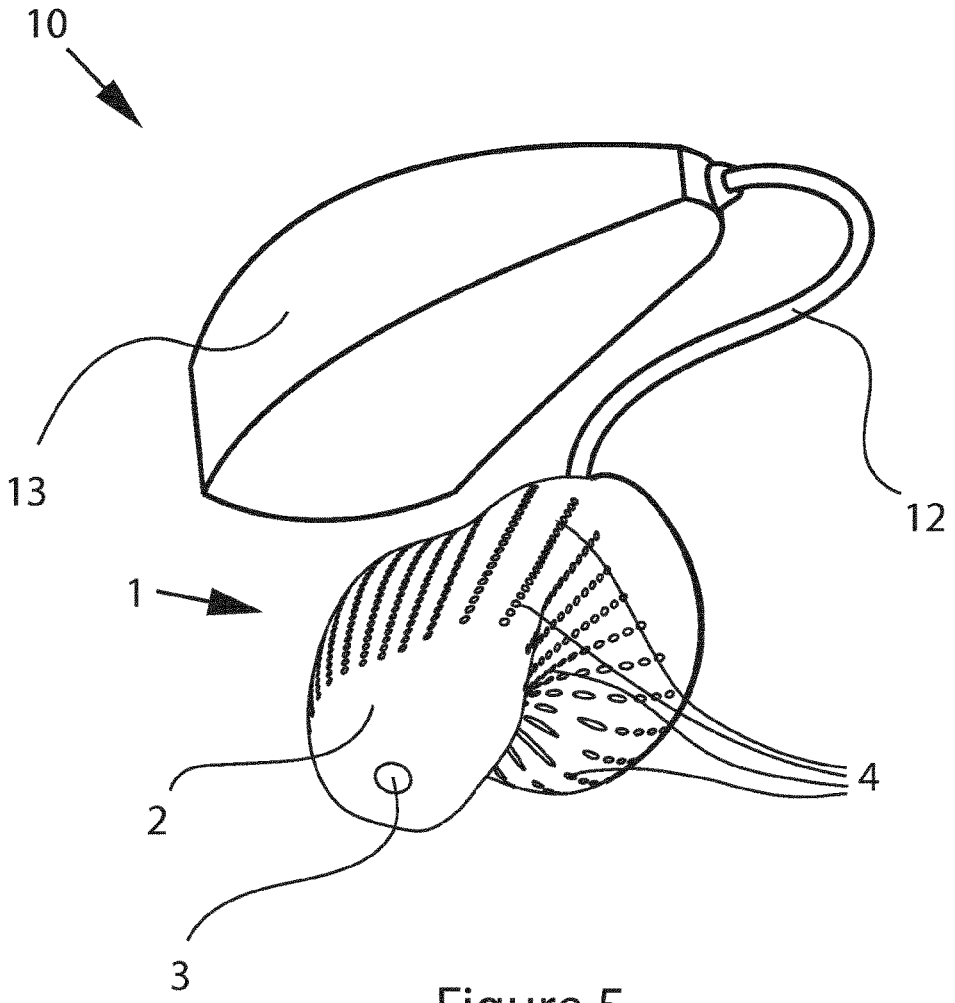

FIG. 5 is a perspective view of a hearing aid comprising an earpiece for coupling a hearing aid to the ear of a hearing aid user, designed according to a further embodiment the present invention, wherein the earpiece comprises a seal in the form of an earmold, modified according to the innovative approach of the present invention With reference initially to FIGS. 1 and 1A, a hearing aid 10 is shown comprising a conventional earpiece 6 for acoustically and physically coupling the hearing aid 10 to the ear 20 of a hearing aid user.

In the example shown, the hearing aid 10 takes the form of a BTE model, having a casing 13 to be retained behind the ear 20 of a user. Such casing 13 normally accommodates a microphone; a receiver; and a signal processing circuitry configured to receive from the microphone an electrical input signal and to provide the receiver with a corresponding electrical output signal. A thin tubing 12 is designed to deliver sound emitted by the receiver into an ear canal 30 of the user. In order to hold the thin tubing 12 securely and comfortably in place in the ear canal 30, an earpiece 6 is used which is provided with a conventional seal 7, otherwise designated as tip or dome, which is fit onto the end of the thin tubing 12 and intended for placement inside the ear canal 30.

An output sound, resulting from the conversion of the abovementioned electrical output signal by the receiver, is thus outlet and delivered to the tympanic membrane 35 via a sound bore 3 incorporated in the seal 7.

According to the current approach adopted in open fitting, the earpiece 6 couples the hearing aid 10 to the ear 20 of a hearing aid user by way of a seal 7 which integrates a small number of vents 8, namely six in the specific representation. Such vents 8, in the form of open channels, put the ear canal 30 in communication with the air outside the ear canal 30.

As already pointed out, such a reduced number of relatively large vents 8 results in a very partial, approximate and imprecise capability of adjusting the acoustic characteristics associated with an open fitting of the hearing aid 10; moreover, the dimensions of the vents 8 commonly used adversely affect the mechanical stability of the seals 7, and therefore of the earpieces 6, in the ear canal 30.

Differently from the case portrayed in FIGS. 1 and 1A of a prior art earpiece 6, an earpiece 1 for coupling a hearing aid 10 to the ear 20 of a hearing aid user according to the present invention is expressly conceived to precisely tailor a desired leakage level; to achieve a predetermined occlusion effect and, concurrently, to customize the extent to which unamplified sounds from the outside should reach the eardrum or to which the natural ear canal resonance should be damped.

An earpiece 1 according to the present invention comprises a seal 2 conforming to the shape of the user's ear canal 30 and therein retained. In the following FIGS. 2 to 4, reference will be made to a seal 2 particularly suitable for instant-fitting, that is a seal which may come in a pre-set, non-individualised configuration, preferably substantially dome-shaped, and which naturally adapts to an intended ear canal 30, without the need to be designed based on an impression taken of such ear canal.

However, as it is also represented in FIG. 5, the inventive concept underlying the present invention can also be applied to the case of a custom earpiece 1 comprising a seal 2 in the form of an earmold, specifically manufactured based on an impression taken of an individual user's ear canal.

Figure 2:
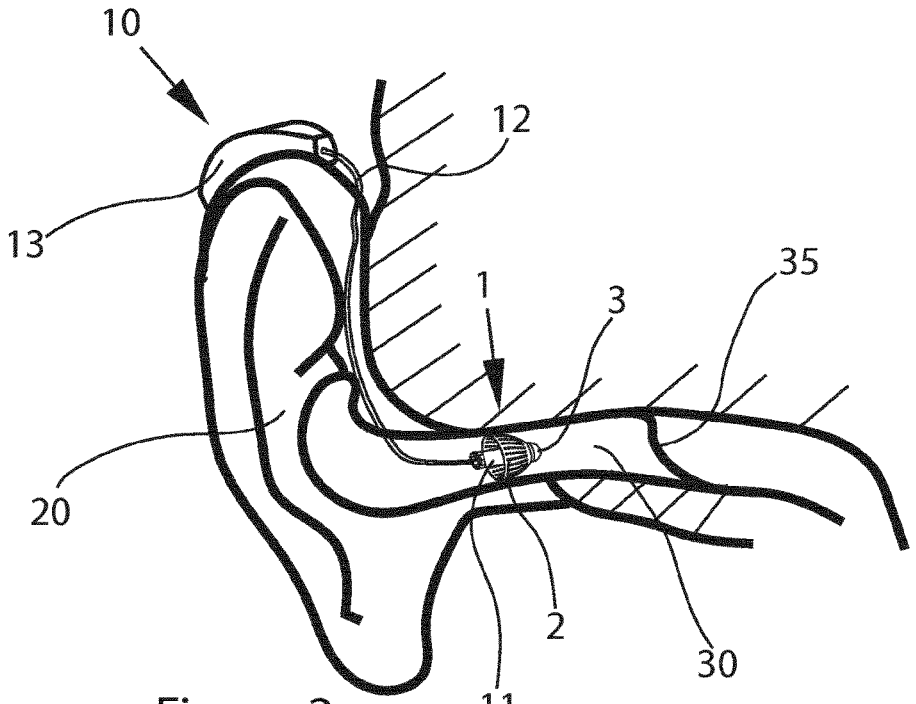
FIG. 2 is a perspective view of a hearing aid comprising an earpiece for coupling a hearing aid to the ear of a hearing aid user, designed according to a first embodiment of the present invention, wherein the earpiece comprises a seal modified according to the innovative approach of the present invention, when inserted in an ear canal.
Figure 2A:
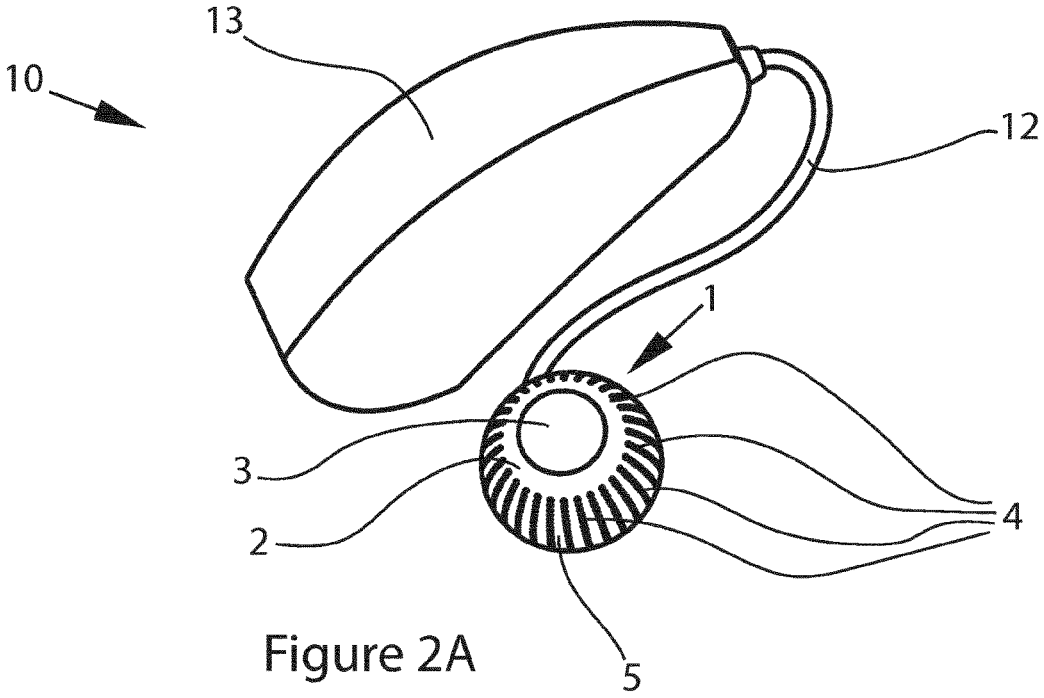
FIG. 2A is a perspective view of the hearing aid of FIG. 2, aimed at better showing an array of openings in the seal according to the present invention.

As shown in FIGS. 2 and 2A, a seal 2 of an earpiece 1 according to the present invention comprises a sound output bore 3 connected to a receiver 11 of a hearing aid 10. The sound output bore 3 gives off a sound output coming from a receiver, both in the case of RIC models, wherein the seal 2 directly engages the receiver 11; and in other models, wherein the seal is simply accommodated on a thin tubing 12 delivering sound emitted from a receiver lodged external to the ear canal, for instance in a casing 13 of the hearing aid.

As opposed to the traditional seals 7 of FIG. 1, a seal 2 in an earpiece 1 according to the present invention comprises a multiplicity of through openings 4, spaced around the sound output bore 3, whose number is comprised in a range of 50 to 2000. Therefore, the openings 4 of the present invention are arranged on a seal 2 according to a fine distribution pattern.

Differently from conventional vents 8 of relatively large size, each one covering a significant portion of a seal 7, each of the openings 4 of the present invention has a diameter in the range of 50 to 250 micrometers.

The high number and the fine dispersion of such openings 4 over the surface of a seal 2 allow to achieve an optimal balance between access of unamplified low frequency sounds from the outside to an eardrum 35; compensation of the reduction of the pressure level of the output sound at hearing frequencies lower than 500 Hz; minimization of risk of acoustical feedback; and a stable, controlled deformation behaviour and a consequent secure holding of the seal 2 within the ear canal 30.

In a preferred embodiments, the number of openings 4 is comprised in a range of about 500 to 1500 openings, having diameters in the range of about 80 to 150 micrometers.

An arrangement of a multiplicity of openings 4 on the seal 2 as described allows to modify the acoustic path by incorporation of a resistive element, acoustically equivalent to said openings 4, and to consistently adjust the overall acoustic response of an earpiece 1 according to the present invention.

The acoustic resistance provided by the openings 4 can be further refined by an adjustment of the aspect ratio of the openings, wherein by aspect ratio of each opening 4 it is meant a ratio between the thickness of the seal 2 and a diameter of the openings 4. The thickness of the seal 2 in the location where a given opening 4 is provided is in general proportional to the actual length of such opening 4.

In case of a seal 2 wherein at least a portion thereof is substantially dome-shaped, the aspect ratio of each of the openings 4 can vary in function of the respective radial position on a curved surface 5 of the seal 2.

In case an opening 4 develops along an axis perpendicular to a plane tangent to the seal surface 5 at an outlet/inlet point of such opening 4, the length of the opening 4 is substantially equivalent to the thickness of the seal 2 at that point.

The aspect ratio of the openings 4 of an earpiece 1 according to the present invention is preferably comprised in a range of 1:4 to 1:10.

In some embodiments, the thickness of the seal 2 can vary locally, to further customize the acoustic characteristics of the venting system correlated to the openings 4.

The openings 4 are configured such that, for a given input signal to a receiver 11 having a predetermined sound pressure level and for a given ear canal 30, a reduction in the ear canal resonance response can be advantageously achieved of at least 5 to 10 dB, when compared to a resonance response of the same ear canal 30 in an open configuration not provided with an earpiece and/or with respect to a resonance response of the same ear canal 30 provided with state of the art open-fit earpieces 6.

In fact, a man skilled in the art knows that in a given range of hearing frequencies generally comprised between 2000-4000 Hz, a natural ear canal amplification of the sound pressure level happens which can prove discomforting if not compensated, when combined with the build-up of pressure in the residual space of the ear canal 30 between earpiece and tympanic membrane 35. The present invention therefore provides a solution to such occurrence, in the way above described.

It is also known in the relevant technical field that in the lower end of hearing frequencies, substantially below 500 Hz, current hearing aids are particularly liable to being overly affected by vent leakage, resulting in an accentuated and unwished loss of gain.

In this regard, the openings 4 of an earpiece 1 according to the present invention are configured so that, for a given input signal having a predetermined sound pressure level and for a given ear canal 30, a gain increase of at least 20 to 30 dB in the pressure level of the output sound from the receiver 11 can be achieved in the range of hearing frequencies below 500 Hz, with respect to a gain in the same ear canal 30 in an open configuration not provided with an earpiece and/or with respect to gains in the same ear canal 30 obtainable with state of the art open-fit earpieces 6. The present invention therefore provides a solution to disappearance of low frequency information, in the way above described.

The advantages of the present invention over the prior art as above highlighted are guaranteed without requiring any additional power consumption, thus enabling a fine tailoring of the acoustic characteristics linked to venting that is also energy efficient.

As visible in FIGS. 2, 2A, 3A and 3B, the sound output bore 3 can be disposed central to a dome-shaped seal 2. The density of the openings 4 can be designed to be higher in proximity of the sound output bore 3 and relatively lower away from the sound output bore 3, in a peripheral area of the seal 2. In this way, the rigidity of the outer region where the seal 2 is meant to contact the walls of the ear canal 30 can be even more easily preserved, at any rate at least to a minimum level sufficient to ensure continuous holding in place of the seal 2.

Figure 3A:
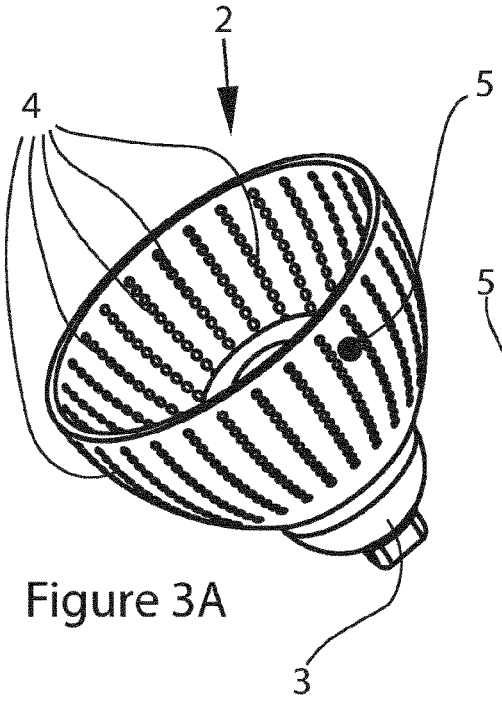
FIG. 3A and FIG. 3B are perspective views of two possible seals which can be incorporated in earpieces according to the present invention.
Figure 3B:
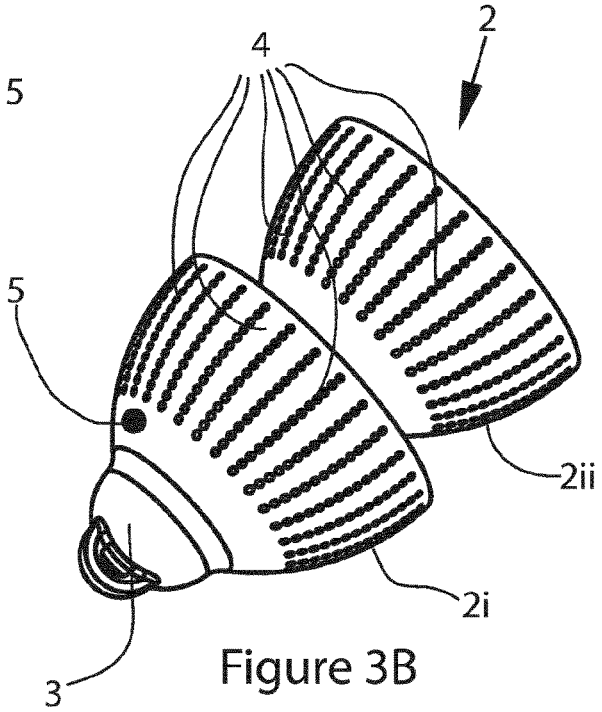
Figure 4:
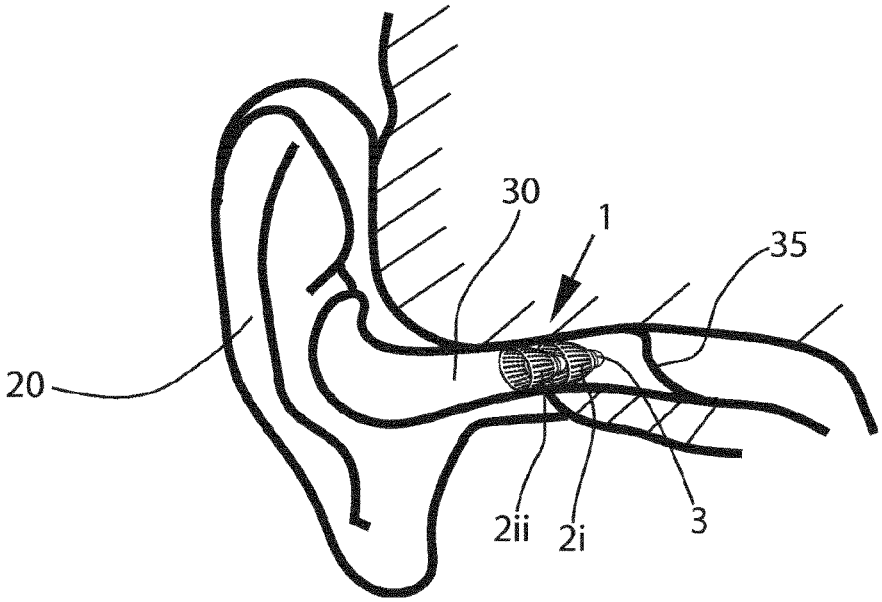
FIG. 4 represents the seal of FIG. 3B, when applied to an earpiece of a completely in the ear hearing aid, wherein the earpiece surrounds an acoustic assembly core.

The seal 2 of FIGS. 2-3A takes the form of a single dome-shaped element. However, as it is exemplified in FIG. 3B and in FIG. 4, a seal 2 of an earpiece 1 according to the present invention can also comprise more than one dome-shaped element. In the specific example portrayed in FIG. 4, a couple of domes 2*i* and 2*ii* are incorporated in an earpiece 1 of a completely within the ear (CIC) hearing device. In this case—where no external casing 13 is needed for positioning the hearing device behind the ear—the earpiece 1 itself substantially surrounds and supports in the ear canal 30 an acoustic assembly core which comprises the electroacoustic transducers and the processing units necessary to the functioning of the hearing aid.

In an earpiece 1 according to the present invention, the seal 2 can be formed from a polymeric material, such as polymeric material comprising rubbers or foams formed from polyurethanes, silicones, polyethylenes, fluoropolymers and copolymers thereof. Said polymeric material is configured to conform to the shape of the ear canal 30 and exert compressive forces on the walls thereof.

Not only ensuring that the seal 2 holds in place in the ear canal is paramount, but also preserving the hygiene and the continued proper functioning of the earpiece 1 itself and of components thereto connected—whether a thin tubing 12 or directly a receiver 11—. Therefore, the polymeric material used for the seal 2 of an earpiece 1 according to the present invention can comprises a hydrophobic material, in the form of a hydrophobic layer or of a coating, to repel moisture or liquid that may form within, or enter into, the ear canal 30. To this end, silicones and fluoropolymers can be used.

For the purpose of allowing an easier cleaning of an earpiece 1, the seal 2 can also be formed from a polymeric material comprising an oleophobic material e.g. as a coating. This way, clogging of the openings 4 by ear wax or cerumen can be also advantageously prevented from happening because greasy matter does not adhere to the surface of the seal 2.

In FIG. 5 is represented a further embodiment the present invention, wherein an earpiece 1 comprises a seal 2 in the form of a customized earmold. The earmold 2, manufactured based on an impression of a user's individual ear canal 30 to replicate the shape thereof, is modified according to the innovative approach of the present invention. In fact, a multiplicity of through openings 4, spaced around a sound output bore 3, are therein created, such that the number of the openings 4 is comprised in a range of 50 to 2000; and the openings 4 have diameters in the range of 50 to 250 micrometers.

The present invention also relates to a method of manufacturing an earpiece 1 for coupling a hearing aid 10 to the ear 20 of a hearing aid user as above described. Such method comprises the step of molding a seal 2 out of a polymeric material, such as a silicone-based or an acrylic-based rubber of foam. The polymeric material used may be initially substantially liquid, such as liquid silicone rubber.

After the molding—or substantially concurrently with the molding operation—the seal 2 is provided with a multiplicity of through openings 4 spaced around the sound output bore 3, wherein the number of said openings 4 is comprised in a range of 50 to 2000.

Additionally, the openings 4 have diameters in the range of 50 to 250 micrometers.

The openings 4 can be provided by laser micromachining the seal 2, after the seal has been created by molding. Laser micromachining, also known as laser ablation, can be carried out in a clean and precise way, allowing to define location and size of the openings 4. Thanks to the flexibility of the processes involved, laser micromachining also enables a quick change of the hole pattern and position, also according to iterative optimization loops during production.

Alternatively, the openings 4 can be provided concurrently with the step of molding the seal 2, in a way that the openings 4 are molded-in through holes.

The invention claimed is:

1. An earpiece for a hearing aid, the earpiece comprising:
a seal configured to deform to a shape of a human ear canal,
wherein the seal is dome-shaped,
wherein the seal has a first section with a sound output bore and the sound output bore is configured to physically couple to a receiver for a hearing aid,
wherein the seal has a second section and the second section includes 50 to 2000 opening,
wherein the openings are laser-cut; and
wherein the openings have diameters from 80 to 150 micrometers.

2. The earpiece of claim 1, wherein the openings have an aspect ratio, wherein the aspect ratio is based on a thickness of the seal and a diameter of the openings, and wherein the aspect ratio is in a range of 1:4 to 1:10.

3. The earpiece of claim 2, wherein at least a portion of the seal is dome-shaped and the aspect ratio of the openings is a function of radial position on the seal.

4. The earpiece of claim 1, wherein the openings are configured to provide a sound pressure level at a given input signal to the receiver and configured to reduce in the ear canal resonance response by at least 5 to 10 dB with respect to a resonance response of the same ear canal in an open configuration not provided with the earpiece.

5. The earpiece of claim 1, wherein the openings are configured to increase an output sound pressure level in a range of hearing frequencies below 500 Hz by at least 20 to 30 decibels (dB).

6. The earpiece of claim 1, wherein a number of the is in a range of about 500 to 1500 openings.

7. The earpiece of claim 1, wherein the sound output bore is disposed centrally in the first section and a density of the openings is higher in proximity to the sound output bore as compared to away a peripheral located away from the sound output bore.

8. The earpiece of claim 1, wherein the seal is comprises a polymeric material, wherein a polymeric material comprises rubbers or foams including polyurethanes, silicones, polyethylenes, fluoropolymers, copolymers, or a combination thereof.

9. The earpiece of claim 8, wherein the polymeric material comprises a hydrophobic material, and wherein the hydrophobic material forms a layer.

10. The earpiece of claim 8, wherein the polymeric material comprises an oleophobic material.

11. A method of manufacturing a component for a hearing aid, the method comprising:
molding a seal,
wherein the seal comprises polymeric material,
wherein the seal is dome-shaped;
forming a sound output bore in a first section of the seal;
forming multiple openings in a second section of the seam,
wherein forming includes laser cutting the multiple openings,
wherein the multiple openings are in range of 50 to 2000 openings, and wherein diameters of the opening is in a range of 80 to 150 micrometers.

12. The method of claim 11, wherein the openings are formed concurrently with molding the seal.

13. A component for a hearing aid, the earpiece comprising:
a seal configured to deform to a shape of a human ear canal,
wherein the seal has a first section with a sound output bore and the sound output bore is configured to physically couple to a receiver for a hearing aid,
wherein the seal is dome-shaped,
wherein the openings are laser-cut,
wherein the seal has a second section and the second section includes 50 to 2000 opening, and
wherein the openings have diameters from 80 to 150 micrometers.

14. The component of claim 13, wherein the diameters of the openings are at least partially based a predetermined sound pressure level and for an ear canal, and wherein the diameters are based on reducing ear canal resonance.

15. The component of claim 13, wherein the aspect ratio of the openings is a function of radial position on the seal.

* * * * *